US007275600B2

(12) United States Patent
Burge

(10) Patent No.: US 7,275,600 B2
(45) Date of Patent: Oct. 2, 2007

(54) APPARATUS AND METHOD FOR EXPANDING TUBULAR MEMBERS

(75) Inventor: Philip Michael Burge, Westhill (GB)

(73) Assignee: E2Tech Limited, Houston, TX (US)

( * ) Notice: Subject to any disclaimer, the term of this patent is extended or adjusted under 35 U.S.C. 154(b) by 241 days.

(21) Appl. No.: 10/502,708

(22) PCT Filed: Jan. 16, 2003

(86) PCT No.: PCT/GB03/00138

§ 371 (c)(1),
(2), (4) Date: Jul. 27, 2004

(87) PCT Pub. No.: WO03/064813

PCT Pub. Date: Aug. 7, 2003

(65) Prior Publication Data

US 2005/0145390 A1 Jul. 7, 2005

(30) Foreign Application Priority Data

Jan. 29, 2002 (GB) ..... 0201955.2

(51) Int. Cl.
*E21B 23/00* (2006.01)

(52) U.S. Cl. ..... 166/380; 166/384; 166/207

(58) Field of Classification Search ..... None
See application file for complete search history.

(56) References Cited

U.S. PATENT DOCUMENTS

| | | | | |
|---|---|---|---|---|
| 4,058,163 | A | 11/1977 | Yandell | |
| 4,285,224 | A * | 8/1981 | Shkatov et al. | 72/56 |
| 4,384,625 | A | 5/1983 | Roper et al. | |
| 4,890,682 | A | 1/1990 | Worrall et al. | |
| 6,695,065 | B2 * | 2/2004 | Simpson et al. | 166/384 |
| 2003/0051885 | A1 * | 3/2003 | Simpson et al. | 166/384 |
| 2004/0251035 | A1 * | 12/2004 | Simpson et al. | 166/384 |

FOREIGN PATENT DOCUMENTS

| | | |
|---|---|---|
| GB | 2 261 238 | 5/1993 |
| GB | 2 272 924 | 6/1994 |
| WO | WO98/00626 | 1/1998 |
| WO | WO 02/103150 | 12/2002 |

OTHER PUBLICATIONS

PCT International Search Report dated May 27, 2003 from International Application No. PCT/GB03/00138.

GB Examination Report, Application No. GB0415090.0, dated Apr. 15, 2005.

* cited by examiner

*Primary Examiner*—Frank Tsay
(74) *Attorney, Agent, or Firm*—Patterson & Sheridan, L.L.P.

(57) ABSTRACT

Apparatus and methods of expanding tubular members are disclosed. In one embodiment, the apparatus includes a vibrating device that is capable of imparting a longitudinal and/or lateral and/or oblique vibration to a tubular member or string as it is being run into a borehole or wellbore. In another embodiment, the vibrating device imparts a longitudinal and/or lateral and/or oblique vibration to a tubular member and/or expander device, as the tubular member is being radially expanded by the expander device.

27 Claims, 2 Drawing Sheets

APPARATUS AND METHOD FOR EXPANDING TUBULAR MEMBERS

CROSS-REFERENCE TO RELATED APPLICATIONS

This application claims benefit of PCT International application No. PCT/GB03/00138 filed on Jan. 16, 2003, entitled "Apparatus and Method for Expanding Tubular Members", which claims benefit of British application Ser. No. 0201955.2, filed on Jan. 29, 2002.

The present invention relates to apparatus and methods for expanding tubular members, and in particular apparatus and methods that help to avoid downhole tubulars from becoming differentially stuck when running the tubulars into a borehole and/or when radially expanding them.

DESCRIPTION OF THE RELATED ART

It is known to use downhole tubular members that are capable of being radially expanded to case, line and repair boreholes. The tubular members are typically of a ductile material so that they can undergo plastic and/or elastic deformation to increase their inner and outer diameters.

Differential sticking is a common occurrence in oil, gas and water wells and is the name given to the jamming of a tubular member in the borehole that is usually caused by a high differential pressure between the borehole and the surrounding formation. The pressure in the borehole can be significantly higher than the pressure in the formation, and the higher pressure in the borehole tends to push downhole tubulars and other apparatus towards the wall of the borehole where they can become jammed or stuck.

This differential sticking can be made worse by a build up of solids or "filter cake" (filtrate) on the face of the borehole. The build up is typically due to fluid (e.g. mud) loss into the formation because the differential pressure between the borehole and the formation causes the fluid to be forced from the high pressure borehole into the low pressure formation. Solid particles in the mud separate out as the larger particles cannot pass into the formation because of the structure thereof, and the particles tend to form a build up of solids or filtrate on the wall of a borehole. The filtrate is typically a relatively thin coating and can help to seal and stabilise the borehole walls, but too much of this can cause the downhole tubulars and apparatus to stick to the walls, particularly when the tubulars stop moving, and the filtrate acts as a seal.

BRIEF SUMMARY OF THE INVENTION

According to a first aspect of the present invention, there is provided apparatus for expanding a tubular member, the apparatus comprising a vibrating device and an expander device.

According to a second aspect of the present invention, there is provided a method of expanding a tubular member in a borehole, the method comprising the step of vibrating the tubular member before, during and/or after expansion.

The present invention also provides a method of preventing a string from becoming stuck in a wellbore, the method comprising the steps of vibrating the string while being run into the wellbore.

The string may comprise a string of tubular members, downhole apparatus (e.g. tools, instrumentation, drill bits etc), or a combination of these and other components.

The vibrating device is typically capable of imparting a longitudinal and/or lateral vibration to the expander device and/or the tubular member. It will be appreciated that a longitudinal vibration means a vibration that is applied on a longitudinal axis of the tubular member and/or the expander device, or on an axis that is coplanar or parallel to the longitudinal axis of the tubular member and/or expander device. A lateral vibration is typically a vibration on an axis that extends across the longitudinal axis of the tubular member (e.g. one that is substantially perpendicular to the longitudinal axis of the tubular member and/or the expander device), or on an axis that is coplanar or parallel to the axis that is substantially perpendicular to the longitudinal axis of the tubular member and/or expander device. It will also be appreciated that the vibrations may be on an oblique axis that is, for example, across the longitudinal axis but not perpendicular thereto. The vibrating device is preferably capable of applying at least longitudinal vibration to the tubular member. The vibrating device may comprise a Baker Oil Tools RATTLER™ downhole tool or the like. The vibrating device provides the advantage that the tubular member and/or the expander device can be vibrated on a longitudinal and/or lateral and/or oblique axis whilst being run into the borehole. Thus, the tubular member is less likely to become stuck due to differential pressure. Also, the vibrating device provides the advantage that the tubular member and/or the expander device can be vibrated on a longitudinal and/or lateral and/or oblique axis whilst the member is being radially expanded. This reduces the amount of friction between the expander device and the tubular member, making the expansion process more efficient and reduces the possibility of the expander device becoming stuck.

The vibrations are typically applied at least for the duration of the expansion process and/or whilst the tubular member or string is being run into the borehole.

Optionally, the vibrations may be applied after completion of the expansion process. For example, vibrations may be applied whilst the apparatus is being retrieved from the borehole to reduce friction, or during circulation of cement.

The vibrating device is typically actuated by the flow of fluid (e.g. mud, water, brine, cement etc) therethrough. Other means of actuation may also be used depending upon the particular type of vibrating device. For example, the vibrating device may be electrically-operated or petrol- or diesel-driven.

The expander device typically comprises an expansion cone. The cone is preferably of a material that is harder than the tubular member that it has to expand. Steel or a steel alloy is typically used. Tungsten carbide or a ceramic material may also be used. Combinations of these and/or other materials may also be used. For example, a harder material (e.g. ceramic, tungsten carbide etc) may be used to coat the portion(s) of the cone that come into contact with the tubular member during expansion thereof.

The expander device is typically attached to a conduit, such as a portion of drill string, a coiled tubing string or the like. It is preferable that the expander device be coupled to a conduit having a relatively small diameter. The vibrating device is preferably coupled (e.g. by screw threads) to the tubular member that is to be expanded. The tubular member is typically coupled to a string (e.g. a string of drill pipe or a coiled tubing string). In this particular embodiment, a seal assembly is preferably located between the conduit and the tubular member. The seal assembly preferably allows the conduit with the expander device to move, whilst the tubular member and string remain stationary. This has the advantage that the expansion of the tubular member does not require movement of the string.

Alternatively, the vibrating device may be coupled into the same conduit as the expander device. The tubular member is typically coupled to a string (e.g. a string of drill pipe or a coiled tubing string). In this particular embodiment, a seal assembly is preferably located between the conduit and the string. The seal assembly preferably allows the conduit with the expander device to move, whilst the tubular member and string remains stationary. This has the advantage that the expansion of the tubular member does not require movement of the string.

The expander device is preferably provided with a through-bore or aperture that allows fluid to pass through the conduit to which it is attached, and also through the expander device.

An end of the tubular member is preferably closed. The end can be closed using a threaded cap, ball catcher or the like. Thus, fluid pressure is retained within the tubular member. The end of the tubular member is optionally pre-expanded so that the expander device (e.g. a cone) can be located therein.

The expander device can be provided with a seal (e.g. an O-ring or lip-type seal) so that fluid pressure is retained on one side of the device (e.g. underneath).

The step of actuating the vibrating device typically comprises circulating fluid therethrough, although the particular method used depends upon the type of vibrating device that is used. The fluid may be circulated using any conventional means.

The step of actuating movement of the expander device typically comprises the step of circulating fluid through the conduit and the expander device. This builds up fluid pressure (typically under the expander device), causing it to be forced upwards and thus expand the tubular member.

The method typically includes the additional step of coupling the vibrating device into a first string. The vibrating device may be coupled into the string using any conventional means (e.g. welding, screw threads etc). The expander device is typically coupled to a second string. In certain embodiments, the first string and the second string are the same. In certain other embodiments, the first string comprises a string of drill pipe, a coiled tubing string or the like, and the second string comprises a conduit of relatively small outer diameter, e.g. drill pipe or coiled tubing. The method may also include the additional step of coupling the tubular member into the first string. The tubular member may be coupled to the first string using any conventional means (e.g. screw threads, welding etc).

Optionally, the method may include the additional step of circulating cement into an annulus between the tubular member and the second conduit. In this particular embodiment, the vibrating device can be used to keep the cement in the annulus moving and prevents solids within the cement from settling, both of which help to improve the final bond.

BRIEF DESCRIPTION OF THE SEVERAL VIEWS OF THE DRAWINGS

Embodiments of the present invention shall now be described, by way of example only, and with reference to the accompanying drawings in which.

DETAILED DESCRIPTION OF THE INVENTION

Figure 1:
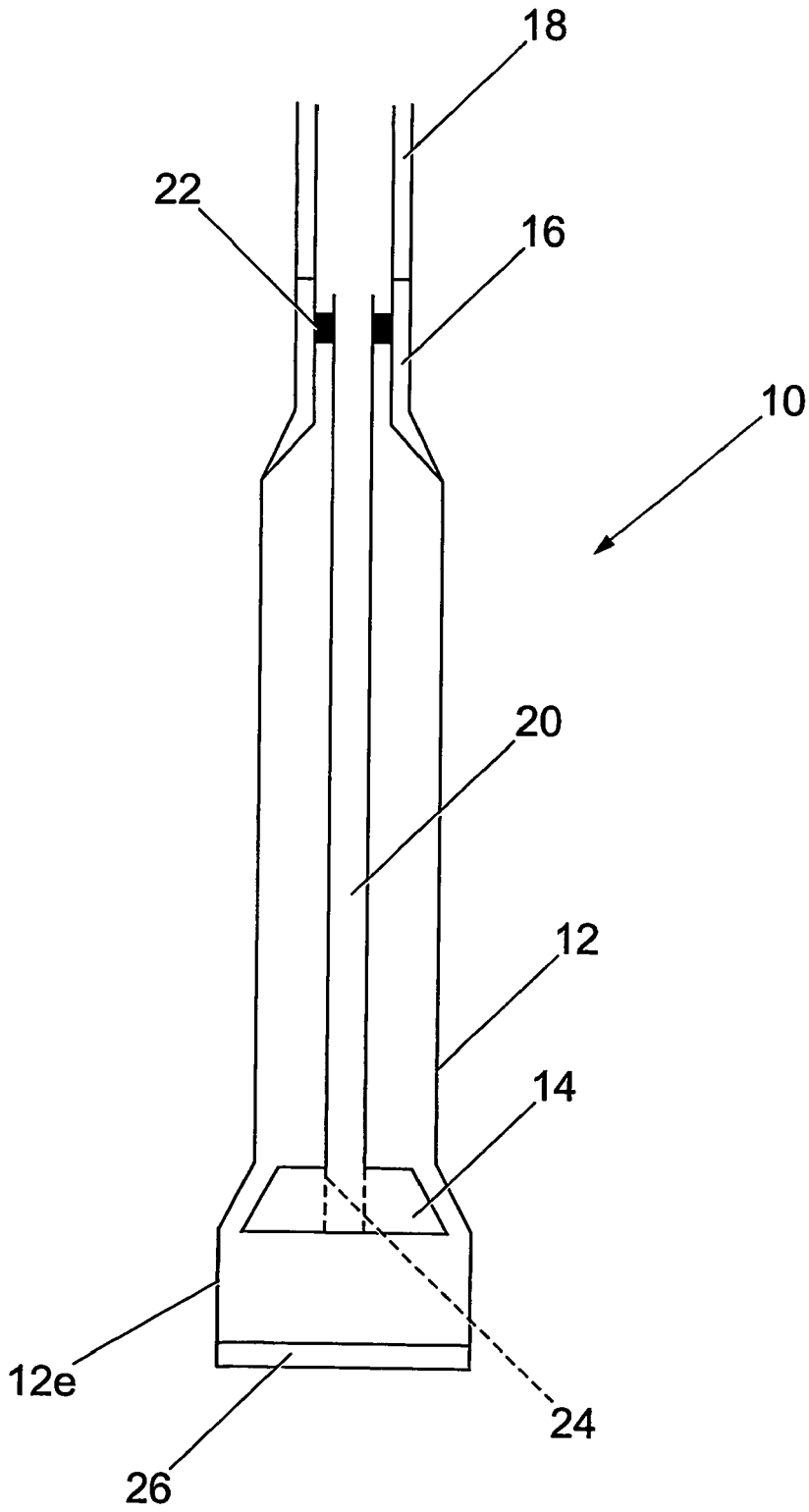
FIG. 1 is a schematic representation of an embodiment of apparatus for expanding a tubular member.

Referring to the drawings, FIG. 1 shows a first embodiment of apparatus, generally designated 10, for use when expanding a downhole tubular 12. The downhole tubular 12 may comprise any tubular, such as drill pipe, liner, casing or the like and is typically of a ductile material so that it can be radially expanded, as will be described. The radial expansion of the tubular member 12 typically causes the member 12 to undergo plastic and/or elastic deformation to increase its inner and outer diameters.

Plastic deformation is a result of the cone 14 being pushed through the tubular member 12, which forces the material (e.g. steel) of the member 12 to bend and stretch around the cone 14 so that it assumes a larger inner and outer diameter. This is because the wall of the tubular 12 engages the face of the cone 14 and is deflected outwardly, as shown schematically in FIGS. 1 and 2. The material of the tubular 12 is typically ductile so that it can deform around the cone 14, providing that the cone 14 is pushed or pulled through the tubular 12 with sufficient force to stretch or bend the material of the tubular 12. The stretched configuration of the material of the tubular member 12 is typically substantially retained after the radial expansion force exerted by the cone 14 is removed; the tubular member 12 relaxes slightly after is it deformed or stretched and this relaxation is termed elastic deformation. The recovery by elastic deformation is typically significantly less than the expansion by plastic deformation, and results in the inner and outer diameters of the expanded tubular member 12 reducing slightly from the initially radially expanded state.

The apparatus 10 includes an expansion cone 14 that can be of any conventional design. The expansion cone 14 is typically of a material that is harder than the material of the tubular 12 that it has to expand. Steel or steel alloys can be used for the cone 12, although ceramic or tungsten carbide may also be used. It will also be appreciated that combinations of these and other materials can be used. For example, the harder materials (e.g. ceramic, tungsten carbide) can be used only on the faces of the cone 14 that come into contact with the tubular member 12 during expansion.

The maximum outer diameter of the expander cone 14 is typically the same as or slightly less than the final inner diameter of the member 12 after it has been expanded.

The cone 14 is typically located in a pre-expanded portion 12*e* of the tubular 12. However, if a collapsible cone (not shown) is used then this may not be necessary. The tubular 12 is typically located in a second conduit (not shown) in use, where the second conduit may comprise an open borehole or a pre-installed casing, liner or the like. The outer diameter of the pre-expanded portion 12*e* is typically less than the inner diameter of the second conduit so that the apparatus 10 can be run into the second conduit in a conventional manner.

The expansion cone 14 can optionally include an inflatable element (e.g. a packer), the function of which shall be described below.

In the embodiment shown in FIG. 1, a vibrating device 16 is attached using any conventional means (e.g. screw threads) to the tubular 12. The vibrating device 16 is used to impart an axial (longitudinal) and/or lateral vibration to the tubular 12 and/or cone 14. Drill pipe 18 or drill collars are typically attached above the vibrating device 16, the drill pipe 18 typically extending back to the surface. The drill pipe 18 typically forms a string of tubular drill members or the like. Coiled tubing may be used in place of the drill pipe 18. The string of drill pipe 18 or coiled tubing provides a conduit back to the surface or vessel for circulation of fluids, and also to facilitate manipulation of the tubulars and the cone 14.

The longitudinal vibration is applied on a plane that is co-planar with or parallel to a longitudinal axis of the tubular member 12 and/or the expander device 14. Similarly, the lateral vibration is applied on a plane that is co-planar with or parallel to an axis that is perpendicular to the longitudinal axis of the tubular member and/or the expander device. Indeed, the vibrations may be on an axis or plane that is oblique, for example an axis that is set at an angle between the longitudinal and lateral axes.

The vibrating device 16 can be of any conventional design, and could be, for example, a Baker Oil Tools RATTLER™ (product family no H14065). The RATTLER™ is a downhole vibration tool that is designed primarily for use in fishing operations and imparts a low frequency impact directly into a fish. The tool operates by circulating fluid therethrough and varying the amount of fluid varies the impact rate directly. A circulation sub (not shown) can be used below the tool to allow unrestricted fluid flow therethrough, and a safety joint may also be used below the tool if required.

The tool typically imparts only a longitudinal or axial vibration, but it will be appreciated that other tools that impart longitudinal, lateral and/or oblique vibrations simultaneously or sequentially may be used.

The frequency of vibration typically depends upon the size and type of tubular, and also the type of formation as the particular filtrate can affect the tendency of the tubular member to stick to the wall of the borehole. Thus, it may be necessary to adjust the frequency and/or amplitude of the vibrations accordingly.

The amplitude of the vibrations can be chosen to suit the particular size and type of tubular, and also the particular filtrate that is present on the walls of the borehole.

It will be appreciated that the frequency and/or amplitude of the vibrations provided by the vibrating device 16 can be increased and decreased during use of the device 16. For example, where the RATTLER™ is being used, the amount of fluid that is circulated through the tool can be changed to vary the frequency of the vibration directly. That is, increasing the amount of fluid flow typically increases the frequency of vibration, and conversely, reducing the amount of fluid flow typically reduces the frequency. Also, the amount of fluid passing through the RATTLER™ can affect the amplitude of the vibrations accordingly. That is, the more fluid that is passed through the tool, the higher the amplitude of the vibrations that it imparts.

The expansion cone 14 is attached (e.g. by screw threads, welding or the like) to a length of conduit 20. Conduit 20 is typically a thin pipe (e.g. with a small wall thickness and/or outer diameter) and is used as a fluid conduit between the drill pipe 18 and the expansion cone 14. The conduit 20 is located within the drill pipe 18 through a seal assembly 22 that provides for upward movement of the cone 16 during the expansion process whilst sealing off the interior of the tubular 12. Note that "upward" is being used with reference to the orientation of the apparatus 10 in FIG. 1.

The cone 14 is provided with a through-bore 24 and a one-way or check valve (not shown). The check valve can be incorporated as part of the conduit 20 or the drill pipe 18. This allows fluid pumped from the surface to flow down through the drill pipe 18, through the conduit 20 and out through the cone 14 into the tubular 12, but the check valve will not allow fluid to flow in the opposite direction. Note that tubular 12 is provided with a threaded cap 26 or other barrier (e.g. a ball catcher) that restrains fluid flow out of the tubular 12. It will also be noted that fluid flows through the vibrating device 16, thus causing it to operate. It will be appreciated that some forms of vibrating device 16 may not be actuated by fluid flow through them.

Expansion is initiated by pumping fluid down the drill pipe 18 and the conduit 20. Hydraulic pressure is contained below the cone 14 at the cap 26 and this results in a build-up of pressure causing upward movement of the cone 14. The cone 14 can be provided with a seal (e.g. an O-ring or lip-type seal) that engages an inner face of the tubular 12 to retain fluid pressure below the cone 14. However, contact between an expansion face of the cone 14 and an inner face of the tubular 12 can provide a metal-to-metal seal.

Movement of the cone 14 causes it to engage the tubular 12 and thus radially expand the tubular 12 by plastically and/or elastically deforming it. The expansion of the tubular 12 can be used to cause it to engage the second conduit in which it is located, although this is not essential as a spacer, seal, packer or the like can be used therebetween. Also, cement can be used in the annulus between the tubular 12 and the second conduit, as will be described.

The inflatable element that can be included as part of the cone 14 can be used to further inflate the pre-expanded portion 12*e* into contact with the second conduit. Also, the inflatable element can be used as a temporary anchor that secures the tubular 12 and holds it in position whilst it is being radially expanded. The inflatable element can either be deflated so that it moves with the cone 14, or can be released therefrom so that the cone 14 travels on its own, the inflatable element being recovered thereafter. A conventional latching mechanism can be used to couple the inflatable element to the cone 14, if required.

The fluid flow also activates the vibrating device 16 and the vibration therefrom keeps the tubular 12 moving and substantially prevents it from becoming differentially stuck. It will be appreciated that the tubular 12 may become differentially stuck if it is not centralised within the second conduit (typically a borehole).

Note that the tubular 12 can be vibrated whilst it is being run into the second conduit by circulating fluid as described above. It will be appreciated that a ball catcher (not shown) may be used in place of the threaded cap 26 to allow fluid to be circulated whilst the apparatus 10 is being run in.

This is particularly advantageous where the tubular 12 is being located in a long, deviated or horizontal borehole where it is likely that the tubular 12 will become differentially stuck.

It will also be appreciated that cement can be circulated (using any conventional means) in the annulus between the tubular 12 and the second conduit to keep the tubular 12 in place. The threaded cap 26 can be drilled out to allow for the circulation of cement in the conventional manner. The vibrations from the vibrating device 16 will help to keep the cement moving between the second conduit and the tubular 12, and can also help prevent solids in the cement from settling, thus improving the final bond between the tubular 12 and the second conduit.

A further advantage of the apparatus 10 is that the expansion process does not require any movement of the drill pipe 18. Movement of the expansion cone 14 is decoupled from movement of the drill pipe 18 and thus the tubular 12. Additionally, in the event that the expansion cone 14 becomes stuck, the drill pipe 18 and vibrating device 16 can be removed from the second conduit and remedial action can be taken to retrieve the conduit 20 and expansion cone 14.

It will be appreciated that once the tubular 12 has been radially expanded, the drill pipe 18 can be rotated against the tubular 12 to release the pipe 18 from the tubular 12 so that the tubular 12 remains in situ. The remainder of the apparatus can then be withdrawn from the borehole.

Alternatively, the tubular 12 can be provided with a screw-threaded attachment at an end thereof so that when the tubular 12 is radially expanded, the screw-threads are released from the threads on the vibrating device 16, allowing the apparatus to be retrieved whilst the tubular 12 remains in situ.

Figure 2:
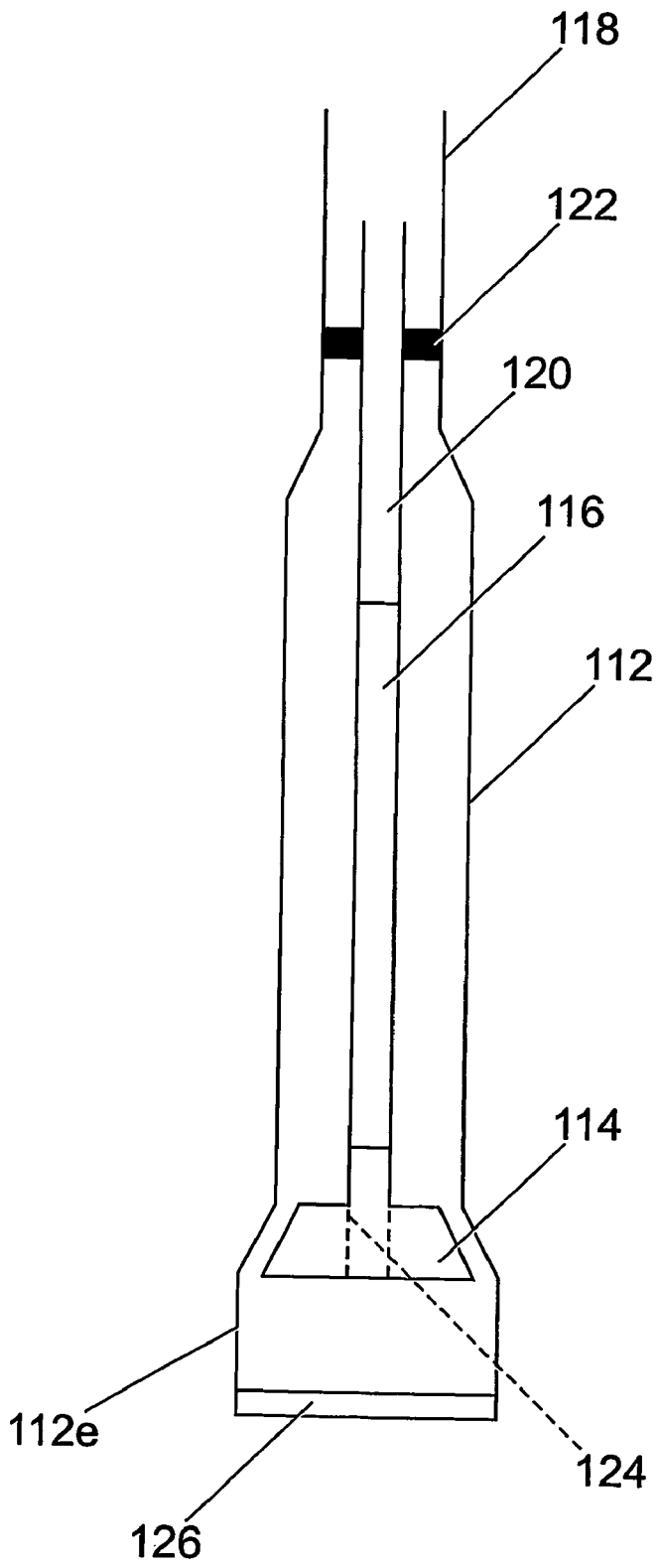
FIG. 2 is a schematic representation of an alternative embodiment of apparatus for expanding a tubular member.

Referring now to FIG. 2, there is shown an alternative apparatus 100 for expanding a tubular 112. Apparatus 100 is similar to apparatus 10 and like parts shall be designated with the same reference numeral pre-fixed "1".

The main difference between apparatus 100 and apparatus 10 is that the vibrating device 116 is located in the conduit 120 and the tubular 112 is coupled directly to the drill pipe 118. The vibrating device 116 can be used to impart lateral and/or radial vibrations to the cone 114, which can be transferred to the tubular 112 either by contact between the cone 114 and the tubular 112, or through the seal assembly 122. This embodiment thus has the same advantages and benefits as the previous embodiment.

In addition to those, the vibrating device 116 can be used to impart longitudinal and/or lateral vibrations to the cone 114. The vibrations reduce the friction between the cone 114 and the tubular 112, thus making the expansion process more efficient.

Modifications and improvements may be made to the foregoing without departing from the scope of the present invention.

The invention claimed is:

1. Apparatus for expanding a tubular member, the apparatus comprising:

a vibrating device coupled to the tubular member that is to be expanded such that the vibrating device is capable of imparting a vibration to the tubular member; and an expander device.

2. Apparatus according to claim 1, wherein the vibrating device is capable of imparting, relative to a longitudinal axis of the tubular member, one of a parallel, perpendicular and oblique vibration to a portion of the apparatus selected from the group consisting of the expander device and the tubular member.

3. Apparatus according to claim 1, wherein the vibrating device is actuated by a flow of fluid therethrough.

4. Apparatus according to claim 1, wherein the expander device comprises an expansion cone.

5. Apparatus according to claim 1, wherein the expander device is attached to a conduit.

6. Apparatus according to claim 5, wherein the conduit has a relatively small diameter.

7. Apparatus according to claim 5, wherein the tubular member and the vibrating device are coupled into a string.

8. Apparatus according to claim 7, wherein a seal assembly is located between the conduit and the tubular member.

9. Apparatus according to claim 8, wherein the seal assembly allows the conduit with the expander device to move, whilst the tubular member and string remain stationary.

10. Apparatus according to claim 5, wherein the vibrating device is coupled into the same conduit as the expander device.

11. Apparatus according to claim 10, wherein the tubular member is coupled into a string.

12. Apparatus according to claim 11, wherein a seal assembly is located between the conduit and the string.

13. Apparatus according to claim 12, wherein the seal assembly allows the conduit with the expander device to move, whilst the tubular member and string remain stationary.

14. Apparatus according to claim 1, wherein the expander device is provided with a through-bore that allows fluid to pass through the conduit to which it is attached, and also through the expander device.

15. Apparatus according to claim 1, wherein an end of the tubular member is closed.

16. A method of expanding a tubular member in a borehole, the method comprising the step of vibrating the tubular member, at least one of before, during and after expansion.

17. A method according to claim 16, wherein the step of vibrating the tubular member includes the additional step of actuating a vibrating device attached to the tubular member.

18. A method according to claim 17, wherein the step of actuating the vibrating device comprises circulating fluid therethrough.

19. A method according to claim 16, wherein the method includes the step of actuating movement of an expander device to impart a radial expansion force to the tubular member.

20. A method according to claim 19, wherein the method includes the additional step of coupling the vibrating device into a first string.

21. A method according to claim 20, wherein the method includes the additional step of coupling the expander device into a second string concentrically disposed inside the first string.

22. A method according to claim 16, wherein the tubular member is vibrated on an axis parallel to one of a longitudinal, lateral and oblique axis of the tubular member.

23. A method of expanding a tubular member in a borehole, the method comprising the step of vibrating an expander device during expansion of the tubular member to thereby impart a vibration to the tubular member.

24. A method according to claim 23, wherein the step of vibrating the expander device includes the additional step of actuating a vibrating device attached to the expander device.

25. A method according to claim 24, wherein the step of actuating the vibrating device comprises circulating fluid therethrough.

26. A method according to claim 23, wherein the method includes the step of actuating movement of the expander device to impart a radial expansion force to the tubular member.

27. A method according to claim 23, wherein the tubular member is vibrated on an axis parallel to one of a longitudinal, lateral and oblique axis of the tubular member.

* * * * *